US008876015B2

(12) United States Patent
Gart et al.

(10) Patent No.: US 8,876,015 B2
(45) Date of Patent: Nov. 4, 2014

(54) HOOK BOLT FOR THE ATTACHMENT OF RAILS TO HOLLOW SLEEPERS

(75) Inventors: Eugen Gart, Ludenscheid (DE); Sebastian Schafer, Bergheim-Glessen (DE)

(73) Assignee: Vossloh Werke GmbH, Werdohl (DE)

( * ) Notice: Subject to any disclaimer, the term of this patent is extended or adjusted under 35 U.S.C. 154(b) by 186 days.

(21) Appl. No.: 13/582,484

(22) PCT Filed: Mar. 3, 2010 (Under 37 CFR 1.47)

(86) PCT No.: PCT/EP2010/052683

§ 371 (c)(1), (2), (4) Date: Jan. 22, 2013

(87) PCT Pub. No.: WO2011/107148

PCT Pub. Date: Sep. 9, 2011

(65) Prior Publication Data

US 2013/0126629 A1 May 23, 2013

(51) Int. Cl.
*E01B 9/34* (2006.01)

(52) U.S. Cl.
CPC ..... *E01B 9/34* (2013.01)
USPC ..... 238/351; 238/331; 238/316

(58) Field of Classification Search
CPC ..... E01B 9/486; E01B 9/483; E01B 9/32; E01B 9/46; E01B 9/66; E01B 9/34; F16B 37/044; F16B 37/045; F16B 37/0807
USPC ..... 238/349, 351, 316, 367, 368, 369, 371, 238/377, 375, 338, 304, 331, 347; 411/542
See application file for complete search history.

(56) References Cited

U.S. PATENT DOCUMENTS 3,640,460 A * 2/1972 Baseler ..... 238/349
6,499,667 B1 * 12/2002 Rhodes et al. ..... 238/264

FOREIGN PATENT DOCUMENTS

DE 46475 C 4/1889
DE 9011846 U1 10/1990
DE 4116306 A1 11/1992
WO 0031343 A1 6/2000

OTHER PUBLICATIONS

English translation of International Preliminary Report on Patentability and Written Opinion, dated Sep. 25, 2012, with respect to International Application No. PCT/EP20101052683.
International Search Report dated Aug. 25, 2010 with respect to International Application No. PCT/EP2010/052683.

* cited by examiner

*Primary Examiner* — Mark Le
(74) *Attorney, Agent, or Firm* — Scott R. Cox

(57) ABSTRACT

A hook bolt for fastening rails to hollow sleepers, in particular steel sleepers, including an engagement element made of cast metal, which has a hook-shaped insertion section and a contact section, which has a receiving space for receiving a threaded element, wherein the threaded element has a threaded bolt and a receiving shoe and the receiving shoe is dimensioned in such a way that the receiving shoe can be inserted into the receiving space of the contact section in a form-fit manner.

9 Claims, 6 Drawing Sheets

HOOK BOLT FOR THE ATTACHMENT OF RAILS TO HOLLOW SLEEPERS

FIELD OF THE INVENTION

The invention concerns a hook bolt for the attachment of rails to hollow sleepers, in particular steel sleepers, and also a rail attachment system using such hook bolts.

PRIOR ART

Current railway sleepers can consist of a solid material such as wood or concrete, for example, but can also be configured as hollow sleepers. When using wooden sleepers the attachment of the rail to the sleeper is often undertaken by bolting attachment elements directly into the wooden material, but in the case of concrete sleepers bolt anchor plugs are cast into the concrete, into which suitable attachment bolts of a rail attachment system are then bolted.

Such techniques cannot be deployed in the case of hollow sleepers. Here the wall thickness of the sleeper is insufficient to attach an attachment element for the rail attachment system securely such that the requisite forces can be transferred into the hollow sleeper. In the case of hollow sleepers it is therefore of known art to use hook bolts, which have a hook-shaped projection, which can be introduced into the hollow sleeper through an aperture and in the correct installed position of the hook bolt in the rail attachment system is locked in the hollow sleeper in a form-fit manner. In the prior art hook bolts are manufactured as castings. The lower hook-shaped part of the bolt can accommodate the high side forces without any problems, in particular when heavily loaded, by virtue of its structural design. What limits the overall strength of conventional cast hook bolts, however, is the threaded portion, which for geometrical reasons can only possess prescribed maximum dimensions in the overall rail attachment system. By virtue of the good material properties of hot-shaped hook bolts, however, these are deployed as standard, even though the maximum forces that can be transferred are limited by the material properties and the dimensional limitations.

DESCRIPTION OF THE INVENTION

The object of the present invention is to propose a hook bolt for the attachment of rails that can withstand higher loads while being cost effective to produce.

In accordance with the invention the hook bolt for the attachment of rails to hollow sleepers, in particular steel sleepers, comprises an engagement element of cast metal, which comprises a hook-shaped insertion section and also a supporting section, which is designed with a receiving space for purposes of receiving a threaded element. The threaded element has a threaded bolt and also a received shoe, wherein the received shoe is dimensioned such that it can be inserted into the receiving space of the supporting section in a form-fit manner.

The inventive hook bolt is thus manufactured from two parts. The engagement element is thereby connected with the threaded element, in that the received shoe of the threaded element is inserted in a form-fit manner into the receiving space of the engagement element. In this manner it is possible to produce the engagement element and the threaded element from different materials; these are optimised on the one hand in terms of their total costs, and on the other hand in terms of the loads that they can receive. Thus in accordance with the invention the engagement element is of cast metal, which is advantageous by virtue of the complex shape of the hook-shaped insertion section, the more so as the engagement element, by virtue of its constructive design, can also receive high side forces, such as occur in particular under heavy load, without any problems. In contrast the threaded element is preferably produced from steel, which has the advantage that the threaded element, with a threaded bolt dimensioned in the conventional range, can accommodate very high loads, so that the inventive hook bolt can accommodate significantly higher side loads compared with a hook bolt of cast metal of the known prior art.

The inventive rail attachment system comprises at least one hollow sleeper with apertures and also inventive hook bolts, which with their hook-shaped insertion section engage into the apertures of the at least one hollow sleeper. The rail attachment system has, furthermore, angle guide plates, through which the threaded bolt of the hook bolt passes in each case, and also tension clamps, which are fixed in each case onto the threaded bolts by means of attachment elements.

In accordance with a preferred embodiment of the invention the threaded element consists of steel. As has already been explained, in this manner it is possible to accommodate a high load with conventional dimensioning of the threaded bolt. However, alternative materials are also conceivable, which are cost-effectively available and have higher strengths when compared with cast metal.

The hook-shaped engagement element preferably consists of grey cast iron or spheroidal graphite cast iron.

The receiving space of the engagement element is preferably configured such that the received shoe of the threaded element can be pushed into the receiving space by means of a lateral movement in the plane at right angles to the longitudinal axis of the threaded bolt. In the case of a horizontal arrangement of the related steel sleeper this would mean that the received shoe of the threaded element could be pushed into the receiving space of the engagement element by means of a horizontal sliding movement. A simple horizontal translational movement is, on the one hand, simple to execute, but also offers the advantage that if, in the installed state of the rail attachment, the received shoe is pulled upwards in the vertical direction relative to the receiving space, in addition to the form fit a frictional connection is also formed in this manner between the upper face of the received shoe, as located in the installed position, and the correspondingly shaped upper interior wall sections of the receiving space. Such a frictional connection has the additional advantage that any relative movement between received shoe and receiving space in the horizontal direction is automatically counteracted, and thus any self-actuated release of the connection between engagement element and threaded element is prevented.

In accordance with a preferred embodiment of the invention the hook-shaped insertion section of the engagement element has a locking lug, which possesses a stop face oriented essentially in a further plane at right angles to the longitudinal axis of the threaded bolt. Such a locking lug, after correct insertion of the hook-shaped insertion section through a suitably dimensioned aperture in the sleeper, can abut against the upper wall adjacent to the aperture, as seen from the inner cavity of the hollow sleeper, and therefore represents an additional safeguard against the inadvertent release of the insertion section from the aperture of the hollow sleeper. Here the selected shape of a locking lug aids the insertion of the insertion section through the aperture into the inner cavity of the hollow sleeper, while the reverse path is prevented by the stop face as desired.

The locking lug is preferably formed on the outer radius of the essentially arcuate insertion section. In this manner a contact face is located essentially diametrically opposite at both sides of the apertures of the hollow sleeper between the insertion section and the wall of the hollow sleeper; in addition to an improved introduction of the forces into the material of the hollow sleeper this represents first and foremost the most effective position to prevent any undesired slippage of the insertion section out of the hollow sleeper.

In accordance with a preferred embodiment of the invention the hook bolt has in addition a plastic covering, which extends over the supporting section and also the received shoe arranged in the receiving space, and has an aperture for the threaded bolt. Such a plastic covering possesses a plurality of advantages. In the first instance it serves to provide electrical insulation, which is of great importance, in particular with reference to the use of hollow sleepers of metal. A further advantage consists in the fact that the penetration of water into the hollow sleeper is prevented, or at least hindered. The fundamental advantage of the plastic covering, however, consists in preventing the threaded element and in particular the received shoe from slipping out of the receiving space in the unloaded state of the hook bolt. For this purpose the plastic covering has an aperture for the threaded bolt, which, however, does not allow any significant sliding movement between the threaded element and the engagement element and therefore prevents the threaded element from being able to release itself from the engagement element.

SHORT DESCRIPTION OF THE FIGURES

In what follows the invention is described in detail with the aid of the accompanying figures.

WAYS OF IMPLEMENTING THE INVENTION

In the following figures the same elements are designated with the same reference numbers in each case.

Figure 1:
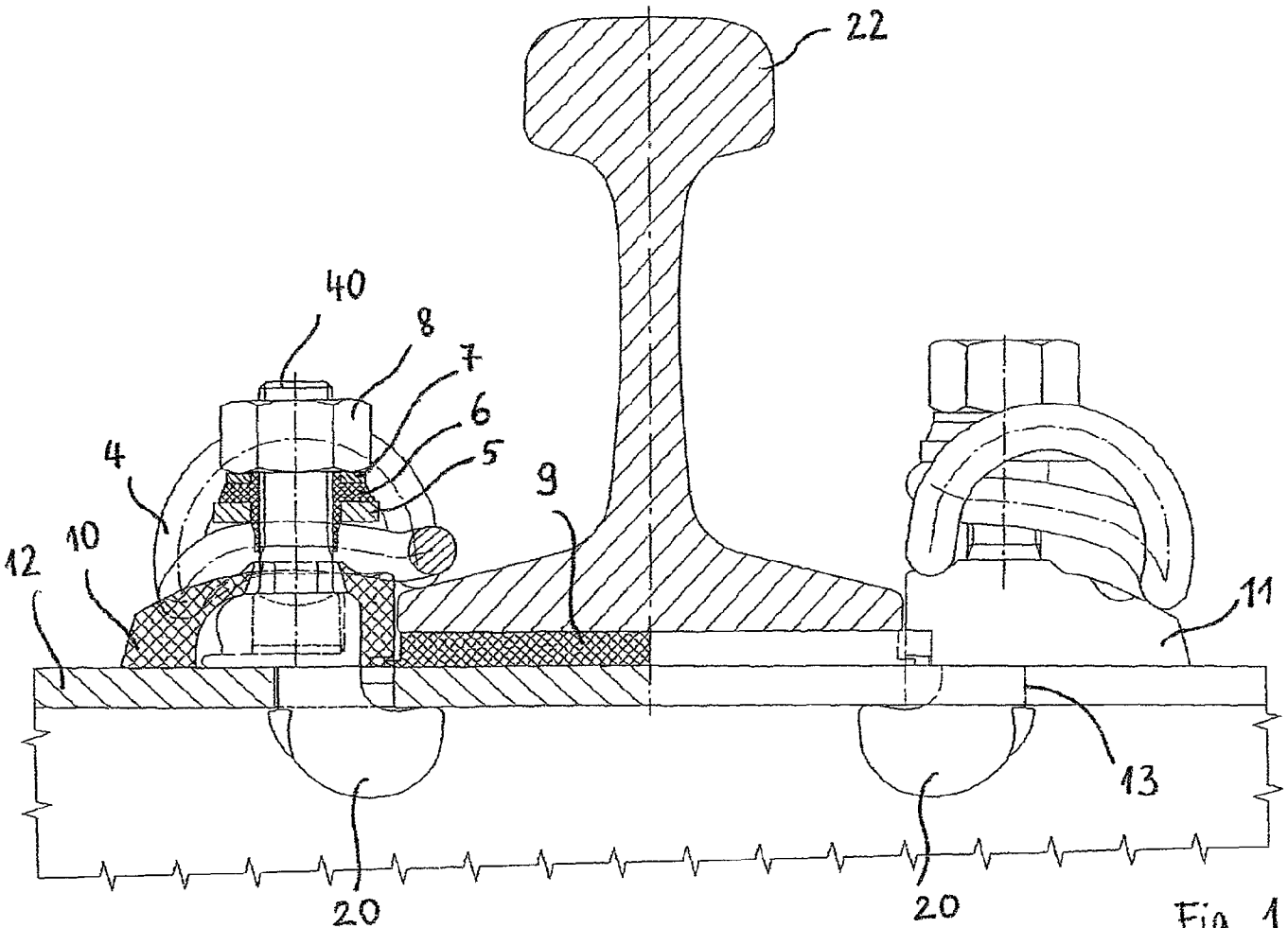
FIG. 1 shows a general view of a rail attachment system using hook bolts.

FIG. 1 shows a rail attachment system using hook bolts, wherein the rail attachment system represented on the left-hand side of the drawing plane of FIG. 1 is represented in the installed position, and the rail attachment system represented on the right-hand side of the drawing plane of FIG. 1 is represented in the pre-installed position.

FIG. 1 shows just the upper wall section of a hollow sleeper 12 that is relevant here; this has apertures 13, which serve to receive an engagement element 20 of a hook bolt 40. The railway track 22 is laid down onto the sleeper 12 via an elastic rail intermediate layer 9 consisting of plastic, and is fixed in position laterally by means of guide plates 10 and 11. The guide plates consist of plastic so as to provide sufficient electrical insulation. In the guide plates are located openings to allow the threaded bolt of the hook bolt 40 to pass through; an attachment nut 8 is screwed onto the threaded bolt in order to secure a tension clamp 4, if necessary with the interposition of an insulating bush collar 6 of plastic; the latter is placed on the threaded bolt and if necessary can be supplemented by additional steel washers 5 and 7 in the direction of the attachment nut 8 and the tension clamp 4. The shapes of the guide plates and tension clamps in FIG. 1 are to be understood as exemplary only, and can possess other geometries that are coordinated with one another in the same manner. Essentially the principle of the hook bolt is that an engagement section 20, which is arcuate, passes through the aperture 13 and into the cavity of the hollow sleeper; the engagement section 20 abuts against the lower face of the upper wall of the hollow sleeper, and in this manner allows the tension clamp 4 to be tensioned against the rail foot. Here the rail attachment system shown on the left-hand side of FIG. 1 is in the installed state, while the rail attachment system represented on the right-hand side of FIG. 1 is in the pre-installed state, in which the attachment nut 8 has not yet been tightened and in which the tension clamp 4 does not yet rest on the foot of the railway track 22.

Figure 2:
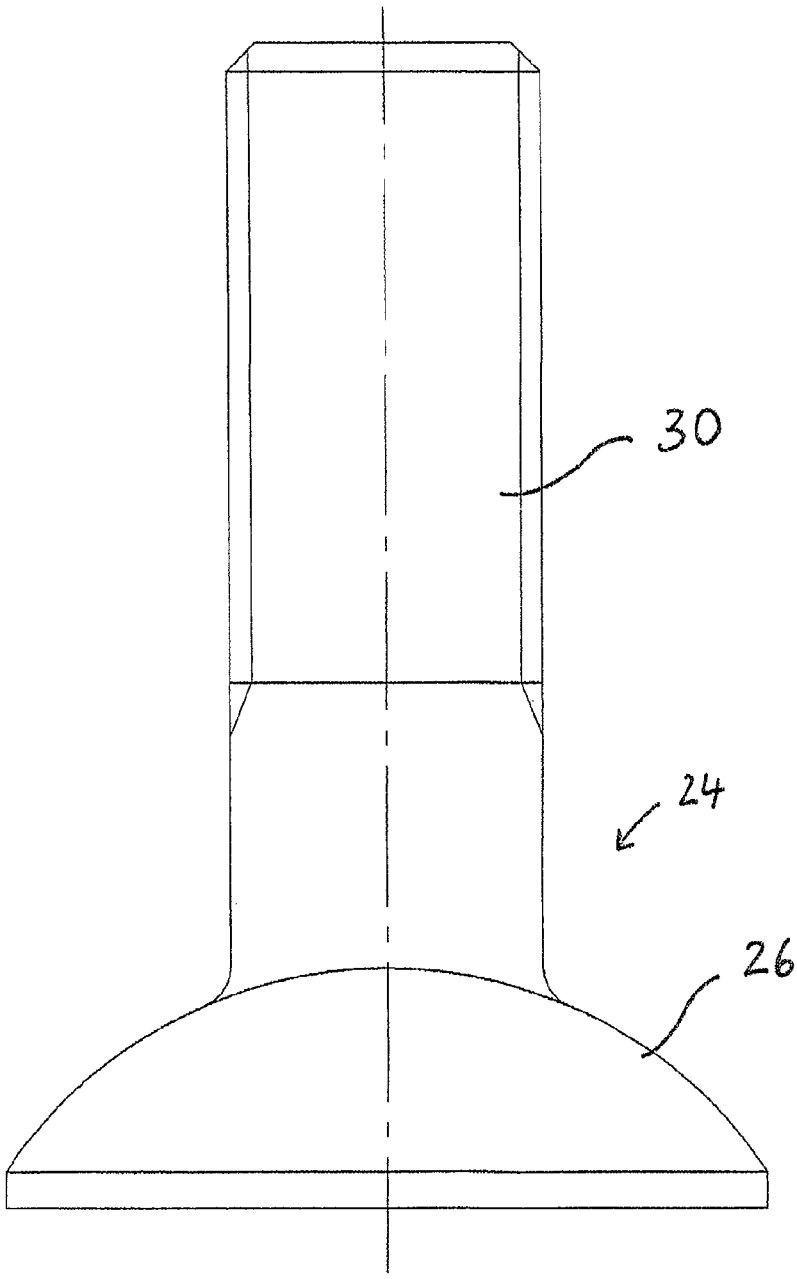
FIG. 2 represents the threaded element of an inventive hook bolt.
Figure 3:
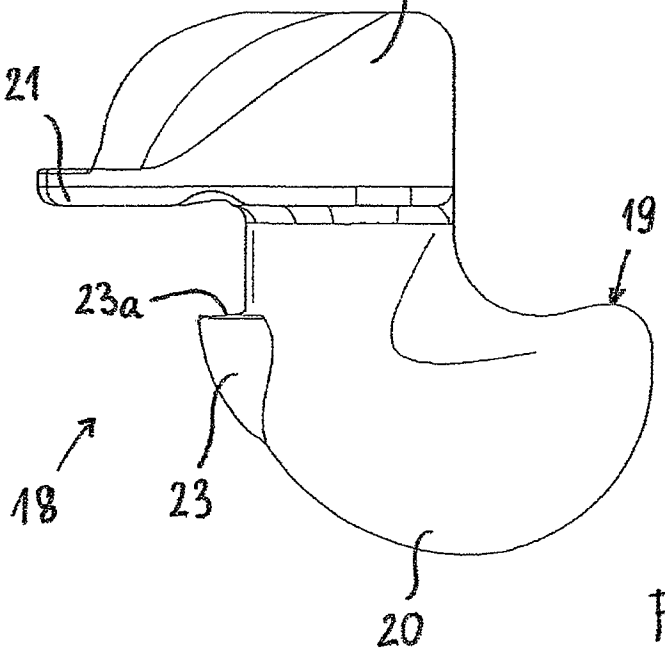
FIG. 3 represents the engagement element of an inventive hook bolt.

FIGS. 2 and 3 show the two separate components of the inventive hook bolt. The threaded element 24 is represented in FIG. 2, while the engagement element 18 is shown in FIG. 3. The threaded element 24 has a threaded bolt 30 with conventional dimensions and a conventional metric thread, such as, for example, an M20 external thread. The thread merges via a transition region into a square section 28, onto which a received shoe 26 is connected; the latter is dimensioned and configured such that it can be pushed into the receiving space, described later, of the engagement element. The threaded element is preferably of steel and can be forged to its basic shape, whereupon in final production steps the exact shape of the received shoe 26 can be finish machined and the external thread on the threaded bolt 30 can be cut.

The second element of the inventive hook bolt is the engagement element 18, which consists of cast metal, preferably grey cast iron or spheroidal graphite cast iron. In this context cast material, by virtue of its high level of toughness, has proved to be very beneficial. The engagement element 18 consists of an insertion section 20 and a supporting section 21 with a receiving space 22 which is dimensioned and configured such that the received shoe 26 of the threaded element 24 can be received in the latter in a form-fit manner.

The insertion section 20 is essentially arcuate in configuration and has a first abutment face 19, which, as can be seen in FIG. 1, in the installed state of the rail attachment system abuts against the inner face of the wall of the hollow sleeper 12 surrounding the aperture 13. In addition the insertion section 20 is provided with a locking lug 23, which is likewise provided with a stop face 23*a*, which in the installed state abuts against the lower face of the upper wall of the hollow sleeper 12, as does the face 19 described above. In the inserted state the supporting section 21 serves the purpose of lying on the upper face of the hollow sleeper.

Figure 5:
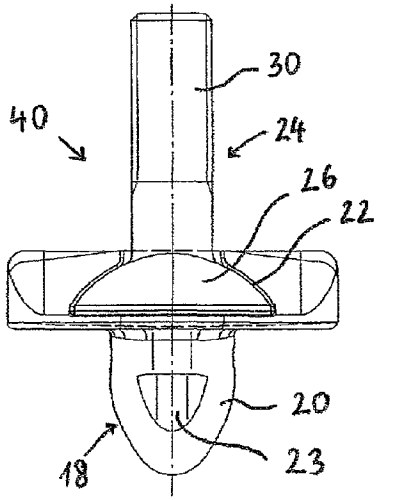
FIG. 5 shows a side view of an inventive hook bolt.
Figure 4:
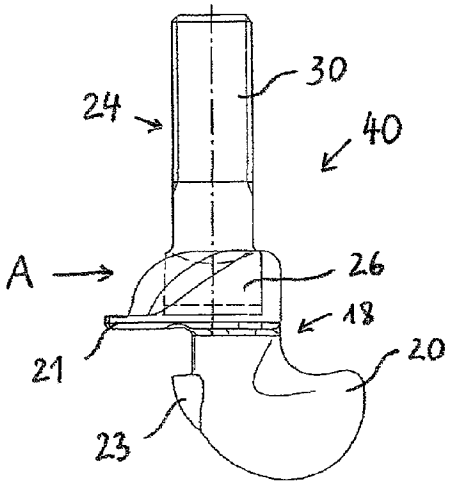
FIG. 4 shows a side view of an inventive hook bolt.

FIG. 4 and FIG. 5 show the inventive hook bolt 40 in the assembled state, i.e. after the threaded element 24 has been pushed into the engagement element 18. Here it can be seen, in particular from the representation in FIG. 5, how the received shoe 26 of the threaded element 24 is received in the receiving space 22 in a form-fit manner, and how the cross-sectional shape of the received shoe 26, which in the present example is in the shape of a circular segment, engages with a small clearance into the receiving space 22 that is shaped in cross-section in a complementary manner to the received shoe, and is held in the receiving space in a form-fit manner. The received shoe 26 is pushed into the receiving space 22 of the engagement element 21 by means of a horizontal sliding movement in the direction of the arrow A (see FIG. 4).

Accordingly the threaded element 24 can only be extracted once again from the engagement element 18 by means of a sliding movement in a direction opposite to that of the arrow A.

Figure 6:
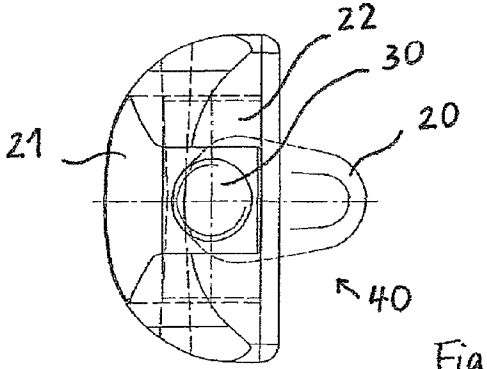
FIG. 6 represents a plan view of an inventive hook bolt.

FIG. 6 shows the hook bolt 40 in plan view and thereby, in particular, makes clear the shape of the supporting section 21 and also the shape of the opening of the receiving space 22.

Figure 8:
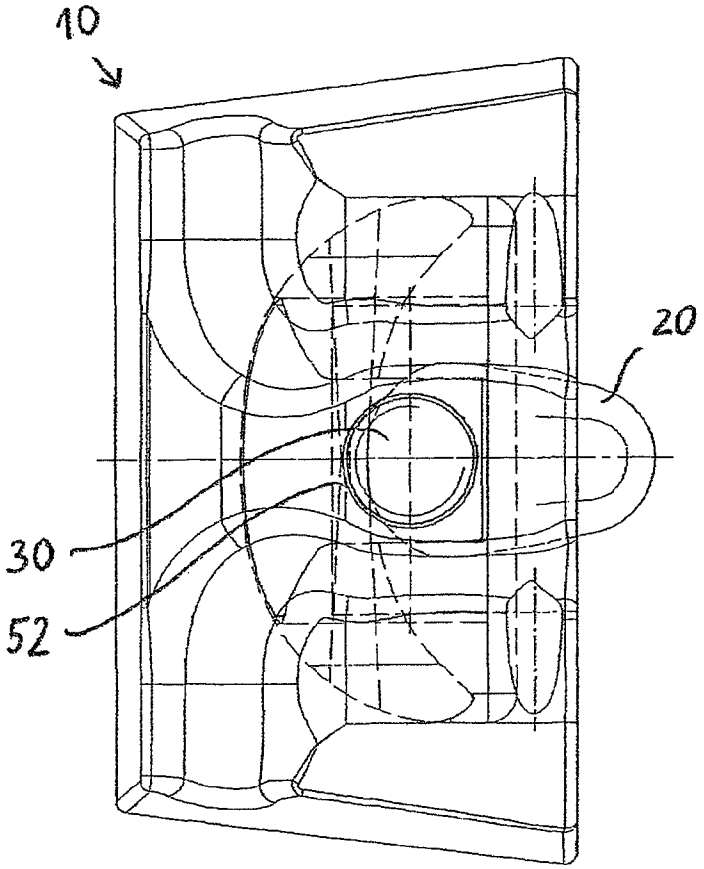
FIGS. 8 and 9 represent a plan view and a view from beneath onto the arrangement represented in FIG. 7 of a hook bolt with a plastic covering.
Figure 7:
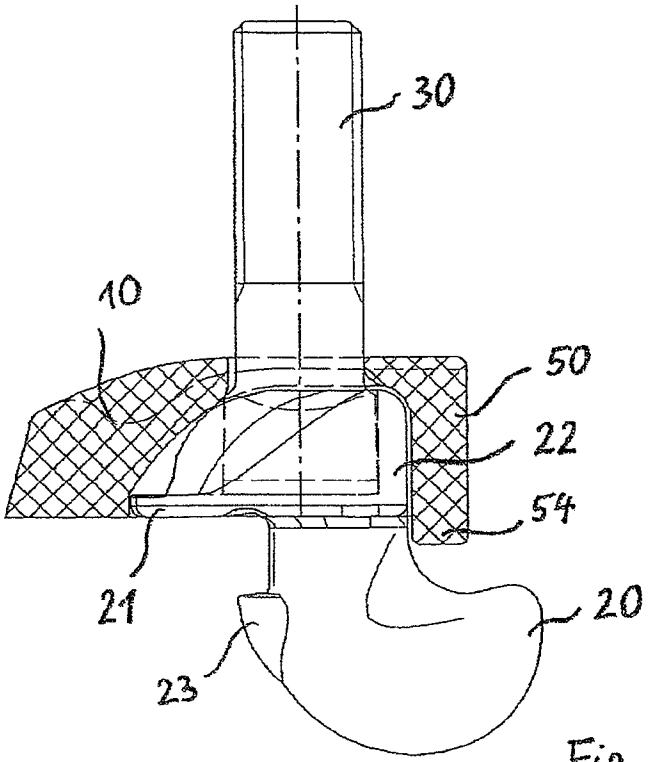
FIG. 7 represents the hook bolt represented in FIG. 4 with, in addition, a plastic covering.

The embodiment in accordance with FIGS. 7 and 8 differs from that in FIGS. 4 and 6 simply in that a covering element 50 is additionally provided, which extends over the supporting section 21 and the receiving space 22 and, as can be seen from FIG. 8, has an opening 52 that serves to enable the threaded bolt 30 to pass through. The provision of the opening 52 in the covering element 50 prevents the threaded element 24 in the installed state from moving in the direction opposite to that the arrow A (see FIG. 4) out of the receiving space 22 of the engagement element 18.

Figure 9:
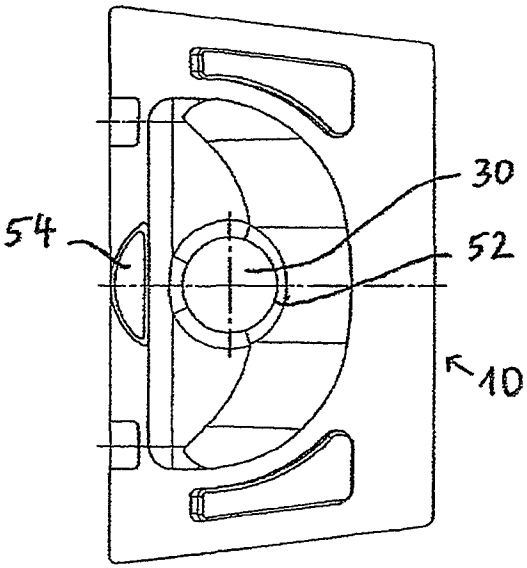

The plastic covering has a lug 54 extending downwards, which, as can be seen from a differently shaped covering in FIG. 1, engages in the aperture 13 of the hollow sleeper 12, and which closes, at least in part, the region of the apertures that remains exposed after the correct insertion of the hook bolt. The lug 54 thus possesses the additional function of preventing any slippage of the hook bolt within the aperture of the hollow sleeper, which function aids the secure positioning of the hook bolt. As can be seen from the representation in FIG. 9, the lug 54 possesses a cross-sectional shape in order to fill the exposed opening cross-section of the hollow sleeper in the best possible manner, and minimises the clearance movement of the hook bolt. This also serves the purpose of countering any premature wear. In the embodiment example in FIG. 9 the lug has a moon-shaped cross-sectional shape.

In addition to the function of electrical insulation and the above-addressed function of preventing the received shoe from coming out of the receiving space, the plastic covering 50 also has the additional task of preventing, or at least reducing, the penetration of moisture into the cavity of the hollow sleeper.

As a result of the two-part configuration of the inventive hook bolt it is possible to cost-effectively produce the individual parts with simple structural shapes and to increase significantly the loads that can be transferred compared with a hook bolt that is manufactured from a single casting. For this reason the inventive hook bolt can also be deployed in the presence of high side forces, such as occur in particular under heavy load.

The invention claimed is:

1. A hook bolt for attachment of rails to hollow sleepers, comprising:

an engagement element of cast metal comprising a hook-shaped insertion section, arranged to abut against a lower surface of an upper wall of the hollow sleeper in an installed state, and a supporting section, arranged to be supported by an upper surface of the hollow sleeper in the installed state, wherein the supporting section is formed with a receiving space to receive a threaded element; wherein the threaded element comprises a threaded bolt and a received shoe which is located in the receiving space; and wherein the received shoe is dimensioned such that it can be inserted by a horizontal sliding movement in one direction into the receiving space of the supporting section in a form-fit manner, and can only be removed by means of a sliding movement in an opposite direction.

2. The hook bolt in accordance with claim 1, characterised in that, the threaded element is comprised of steel.

3. The hook bolt in accordance with claim 1, characterised in that, the hook-shaped engagement element comprises grey cast iron or spheroidal graphite cast iron.

4. The hook bolt in accordance with claim 1, characterised in that, the receiving space of the engagement element is configured such that the received shoe of the threaded element can be pushed into the receiving space at right angles to a longitudinal axis of the threaded bolt.

5. The hook bolt in accordance with claim 1, characterised in that, the hook-shaped insertion section comprises a locking lug, which possesses a stop face oriented essentially in a further plane at right angles to a longitudinal axis of the threaded bolt.

6. The hook bolt in accordance with claim 5, characterised in that, the locking lug is formed on an outer radius of an essentially arcuate insertion section.

7. The hook bolt in accordance with claim 1, further comprising a plastic covering, which extends over the supporting section and wherein the received shoe is arranged in the receiving space, and has an aperture for the threaded bolt.

8. A rail attachment system, comprising:

at least one hollow sleeper with apertures; and hook bolts in accordance with claim 1, which with their hook-shaped insertion sections engage into the apertures of the at least one hollow sleeper;

angle guide plates, through which the threaded bolts of the hook bolts pass; and tension clamps, which are fixed onto the threaded bolts by means of attachment elements.

9. The hook bolt of claim 1 wherein the hollow sleepers comprise steel.

* * * * *